US005441863A

United States Patent [19]

Tang et al.

[11] Patent Number: 5,441,863

[45] Date of Patent: Aug. 15, 1995

[54] PHOTOGRAPHIC ELEMENTS WITH HETEROCYCLIC CYAN DYE-FORMING COUPLERS

[75] Inventors: Ping W. Tang; Thomas H. Jozefiak; David J. Decker, all of Rochester, N.Y.

[73] Assignee: Eastman Kodak Company, Rochester, N.Y.

[21] Appl. No.: 281,898

[22] Filed: Jul. 28, 1994

[51] Int. Cl.[6] ..... G03C 7/38

[52] U.S. Cl. ..... 430/558; 430/384; 430/385

[58] Field of Search ..... 430/558, 384, 385

[56] References Cited

U.S. PATENT DOCUMENTS

| | | | |
|---|---|---|---|
| 4,728,598 | 3/1988 | Bailey et al. | 430/387 |
| 4,873,183 | 10/1989 | Tachibana et al. | 430/550 |
| 4,910,127 | 3/1990 | Sakaki et al. | 430/551 |
| 4,916,051 | 4/1990 | Tachibana et al. | 430/558 |
| 5,206,130 | 4/1993 | Shimada et al. | 430/558 |
| 5,215,871 | 6/1993 | Sato et al. | 430/384 |

FOREIGN PATENT DOCUMENTS

| | | | |
|---|---|---|---|
| 2279337 | 12/1987 | Japan | 430/558 |
| 2289838 | 12/1987 | Japan | 430/558 |
| 1-028638 | 1/1989 | Japan | G03C 7/32 |
| 2-188749 | 7/1990 | Japan | G03C 7/38 |
| 4-172447 | 6/1992 | Japan | G03C 7/38 |
| 4-190348 | 7/1992 | Japan | G03C 7/38 |
| 4-194847 | 7/1992 | Japan | G03C 7/38 |

*Primary Examiner*—Lee C. Wright

*Attorney, Agent, or Firm*—Joshua G. Levitt

[57] ABSTRACT

Novel imidazo[3,2-a]imidazole cyan dye-forming couplers and photographic elements containing them are described. The couplers are represented by the following structure:

wherein:

$EWG_1$ and $EWG_2$ each independently represent an electron withdrawing group;

X is hydrogen or a coupling-off group; and $R^1$ is hydrogen or a substituent group.

9 Claims, No Drawings

PHOTOGRAPHIC ELEMENTS WITH HETEROCYCLIC CYAN DYE-FORMING COUPLERS

FIELD OF THE INVENTION

This invention relates to novel heterocyclic cyan dye-forming couplers and to light sensitive silver halide color photographic elements employing them.

BACKGROUND OF THE INVENTION

In the photographic art color images are formed by exposing a light sensitive silver halide photographic element to actinic radiation, followed by processing in which an oxidized aromatic primary amine color developing agent is reacted with a dye-forming coupler to form yellow, magenta and cyan image dyes in the element.

Known magenta dye-forming couplers include heterocyclic nitrogen compounds such as pyrazolones, pyrazolobenzimidazoles, pyrazolotriazoles and indazolones. Known cyan dye-forming couplers include phenols and naphthols. More recently, some heterocyclic nitrogen compounds have been described as cyan dye-forming couplers. These include the imidazopyrazoles, pyrazolotriazoles and imidazoimidazoles described in U.S. Pat. Nos. 4,728,598, 5,206,130, 4,873,183, 4,916,051 and 5,215,871 and in Japanese Published Patent Applications 01/028638, 02/188749, 04/172447, 04/190348 and 04/194847.

Image dyes in photographic elements should have desired hues and good stability, i.e., they should have little or no fading or discoloration under storage in the dark or when exposed to light. The couplers that provide these dyes should have good coupling efficiency and lead to dye images with good contrast, high density in areas of maximum exposure and low density in minimum exposures areas.

The cyan image dyes formed by phenol or naphthol couplers have desirable spectral absorption characteristics, but their stability is not as great as would be desired. Some cyan image dyes formed from heterocyclic nitrogen couplers have improved stability characteristics, but the spectral absorption characteristic of the dye and the coupling efficiency of the coupler are not as good as would be desired. Thus, it would be desirable to have heterocyclic nitrogen cyan dye forming couplers with good coupling efficiency that provides dyes having desirable spectral absorption characteristics.

SUMMARY OF THE INVENTION

In accordance with the present invention there is provided a light-sensitive photographic element comprising a support bearing a silver halide emulsion associated with an imidazo[3,2-a]imidazole cyan dye-forming coupler having the structure:

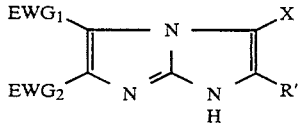

wherein:

$EWG_1$ and $EWG_2$ each independently represent an electron withdrawing group;

X is hydrogen or a coupling-off group; and $R^1$ is hydrogen or a substituent.

The novel imidazoimidazole cyan dye-forming couplers of this invention, upon conventional photographic processing, provide dyes that have desirable spectral absorption characteristics and good stability. In addition, the couplers have good coupling efficiency.

DETAILED DESCRIPTION OF THE INVENTION

Cyan dyes of suitable hue are formed with novel imidazoimidazole couplers of this invention. Preferred couplers of this invention provide, after conventional photographic processing, cyan dyes with a spectral absorption peak in the region of the spectrum from 650 to 710 nm with a half band width of less than 195 nm, preferably less than 150 nm, most preferably less than 100 nm.

Preferably $EWG_1$ and $EWG_2$ are each an electron attractive group having a Hammett sigma p substituent constant of between 0.20 and 1.0, most preferably between 0.30 and 1.0. Hammett sigma p values of common substituents are described in, for example, *Lange's Handbook of Chemistry*, Vol. 12, edited by J. A. Dean, 1979 (McGraw-Hill), and *Chemical Region* No. 122, pp. 96 to 103, 1979 (Nankohdo). Hammett sigma p values for other useful substituents can be calculated using Hammett's rule, which is described in Hansch, Chem. Rev. 1991, 91, 165–195.

Suitable $EWG_1$ and $EWG_2$ substituents include acyl having preferably 1 to 50 carbon atoms, for example, acetyl, 3-phenylpropanoyl, benzoyl, and 4-dodecyloxybenzoyl; acyloxy, for example acetoxy; carbamoyl having preferably 1 to 50 carbon atoms, for example, carbamoyl, N-ethylcarbamoyl, N-phenylcarbamoyl, N,N-dibutylcarbamoyl, N-(2-dodecyloxyethyl) carbamoyl, N-(4-n-pentadecanamide)phenylcarbamoyl, N-methyl-N-dodecylcarbamoyl, and N-[3-(2, 4-di-t-amylphenoxy)propyl]-carbamoyl; alkoxycarbonyl having preferably 2 to 50 carbon atoms, for example, methoxycarbonyl, isopropyloxycarbonyl, tert-butyloxycarbonyl, isobutyloxycarbonyl, butyloxycarbonyl, dodecyloxycarbonyl, and octadodecyloxycarbonyl; aryloxycarbonyl having preferably 7 to 50 carbon atoms, for example, phenoxycarbonyl; cyano; nitro; dialkylphosphono having preferably 2 to 50 carbon atoms, for example, dimethylphosphono; diarylphosphono having preferably 12 to 60 carbon atoms, for example, diphenylphosphono; diarylphosphinyl having preferably 12 to 60 carbon atoms, for example, diphenylphosphinyl; alkylsulfinyl having preferably 1 to 50 carbon atoms, for example, 3-phenoxypropylsulfinyl; arylsulfinyl having preferably 6 to 50 carbon atoms, for example, 3-pentadecylphenylsulfinyl; alkylsulfonyl having preferably 1 to 50 carbon atoms, for example, methanesulfonyl and octanesulfonyl; arylsulfonyl having preferably 6 to 50 carbon atoms, for example, benzenesulfonyl and toluenesulfonyl; sulfonyloxy having preferably 1 to 50 carbon atoms, for example, methanesulfonyloxy and toluenesulfonyloxy; acylthio having preferably 1 to 50 carbon atoms, for example, acetylthio and benzoylthio; sulfamoyl having preferably 0 to 50 carbon atoms, for example N-ethylsulfamoyl, N,N-dipropylsulfamoyl, N-ethyl-N-dodecylsulfamoyl, and N,N-diethylsulfamoyl; thiocyanate; thiocarbonyl having preferably 2 to 50 carbon atoms, for example, methylthiocarbonyl and phenylthiocarbonyl; halogenated alkyl having preferably 1 to 20 carbon atoms, for example, trifluoromethane and heptafluoropropane; halogenated alkoxy having preferably 1 to 20 carbon atoms, for example, trifluoromethyloxy; halogenated aryloxy having preferably 6 to 12 carbon atoms, for example, pentafluorophenyloxy; halogenated alkylamino having preferably 1 to 20 carbon atoms, for example, N,N-di-(trifluoromethyl)amino; halogenated alkylthio having preferably 1 to 20 carbon atoms, for example, difluoromethyl and 1,1,2,2-tetrafluoroethylthio; aryl substituted with an electron withdrawing group having preferably 6 to 20 carbon atoms, for example, 2,4-dinitrophenyl, 2,4,6-trichlorophenyl, and pentachlorophenyl; heterocyclyl having preferably 0 to 40 carbon atoms, for example, 2-benzoxazolyl, 2-benzothiazolyl, 1-phenyl-2-benzimidazol-yl, 5-chloro-1 -tetrazolyl, and 1-pyrrolyl; halogen for example, chlorine and bromine; azo having preferably 6 to 40 carbon atoms, for example, phenylazo; and selenocyanato.

Especially preferred $EWG_1$ and $EWG_2$ substituents are acyl, acyloxy, carbamoyl, alkoxycarbonyl, arloxycarbonyl, cyano, nitro, alkylsulfinyl, arylsulfinyl, alkylsulfonyl, arylsufonyl, sulfamoyl, halogenated alkyl, halogenated alkoxy, halogenated alkylthio, halogenated aryloxy, aryl, and heterocyclyl.

Particularly preferred $EWG_1$ and $EWG_2$ substituents are alkoxycarbonyl, nitro, cyano, arylsulfonyl, carbamoyl, halogenated alkyl and aryloxycarbonyl.

Most preferred $EWG_1$ and $EWG_2$ substituents are cyano.

The coupling off group represented by X can be a hydrogen atom or any of the coupling-off groups known in the art. Coupling-off groups can determine the equivalency of the coupler, can modify the reactivity of the coupler, or can advantageously affect the layer in which the coupler is coated or other layers in the element by performing, after the release from the coupler, such functions as development inhibition, development acceleration, bleach inhibition, bleach acceleration, color correction, and the like. Representative classes of coupling-off groups include halogen, particularly chlorine, bromine, or fluorine, alkoxy, aryloxy, heterocyclyloxy, heterocyclic, such as hydantoin and pyrazolo groups, sulfonyloxy, acyloxy, carbonamido, imido, acyl, heterocyclythio, sulfonamido, alkylthio, arylthio, heterocyclythio, sulfonamido, phosphonyloxy, and arylazo. They are described in, for example, U.S. Pat. Nos. 2,355,169; 3,227,551; 3,432,521; 3,476,563; 3,617,291; 3,880,661; 4,052,212 and 4,134,766; and in U.K. patents and published application numbers 1,466,728; 1,531,927; 1,533,039; 2,066,755A, and 2,017,704A; the disclosures of which are incorporated herein by reference.

Preferably, X is hydrogen or halogen. Most preferably X is hydrogen or chlorine.

$R^1$ represents hydrogen or a substituent. Preferably $R^1$ is a ballast group.

Specific $R^1$ substituents include halogen for example, chlorine and bromine; an aliphatic group having preferable 1 to 32 carbon atoms which may be linear, branched or cyclic, and saturated or unsaturated, for example, alkyl, aralkyl, alkenyl, alkynyl, cycloalkyl and cycloalkenyl, such as methyl, ethyl, propyl, isopropyl, t-butyl, tridecyl, 2-methanesulfonylethyl, 3-(3-pentadecylphenoxy) propyl, 3-[4-{2-[4(4-hydroxyphenylsulfonyl) phenoxy]dodecanamide}phenyl) propyl, 2-ethoxytridecyl, trifluoromethyl, cyclopentyl, and 3-(2,4-di-t-amylphenoxy) propyl; aryl having preferably 6 to 50 carbon atoms, for example, phenyl, 4-t-butylphenyl, 2,4-di-t-amylphenyl, and 4-tetradecanamidephenyl; heterocyclyl having preferably 1 to 50 carbon atoms, for example, 2-furyl, 2-thienyl, 2-pyrimidinyl, and 2-benzothiazolyl; cyano; hydroxy; nitro; carboxy; sulfo; amino; alkoxy having preferably 1 to 50 carbon atoms, for example, methoxy, ethoxy, 2-methoxyethoxy, 2-dodecylethoxy, and 2-methanesulfonylethoxy; aryloxy having preferably 6 to 50 carbon atoms, for example, phenoxy, 2-methylphenoxy, 4-t-butylphenoxy, 3-nitrophenoxy, 3-t-butyloxycarbamoyl-phenoxy, and 3-methoxycarbamoyl; acylamino having 2 to 50 carbon atoms, for example, acetamido, benzamido, tetradecanamido, 2-(2, 4-di-t-amylphenoxy)butanamido, 4-(3-t-butyl-4-hydroxyphenoxy)butanamido, and 2-[4-(4-hydroxyphenylsulfonyl)phenoxy]decanamido; alkylamino having preferably 1 to 50 carbon atoms, for example, methylamino, butylamino, dodecylamino, diethylamino, and methylbutylamino; anilino having preferably 6 to 50 carbon atoms, for example, phenylamino, 2-chloroanilino, 2-chloro-5-tetradecaminoanilino, 2-chloro-5-dodecyloxycarbonylanilino, N-acetylanilino, and 2-chloro-5-[2-(3-t-butyl-4-hydroxyphenoxy)-dodecanamide]anilino; ureido having preferably 2 to 50 carbon atoms, for example, phenylureido, methylureido, and N,N-dibutrylureido; sulfamoylamino having preferably 1 to 50 carbon atoms, for example, N,N-dipropylsulfamoylamino, and N-methyl-N-decylsulfamoylamino; alkylthio having preferably 1 to 50 carbon atoms, for example, methylthio, octylthio, tetradecylthio, 2-phenoxyethylthio, 3-phenoxypropylthio, and 3-(4-t-butyl-phenoxy)propylthio; arylthio having preferably 6 to 50 carbon atoms, for example, phenylthio, 2-butoxy-5-t-octylphenylthio, 3-pentadecylphenylthio, 2-carboxyphenylthio and 4-tetradecanamidephenylthio; alkoxycarbonylamino having preferably 2 to 50 carbon atoms, for example, methoxycarbonylamino and tetradecyloxycarbonylamino; sulfonamido having preferebly 1 to 50 carbon atoms, for example, methanesulfonamido, hexadecanesulfonamido, benzenesulfonamido, p-toluenesulfonamido, octadecanesulfonamido, and 2-methoxy-5-t-butylbenzenesulfonamido; carbamoyl having preferably 1 to 50 carbon atoms, for example, N-ethylcarbamoyl, N,N-dibutylcarbamoyl, N-(2-dodecyloxy-ethyl) carbamoyl, N-methyl-N-dodecylcarbamoyl, and N-[3-(2,4-di-tamylphenoxy) propyl]-carbamoyl; sulfamoyl having preferably up to 50 carbon atoms, for example, N-ethylsulfamoyl, N,N-dipropylsulfamoyl, N-(2-dodecyloxyethyl)-sulfamoyl, N-ethyl-N-dodecylsulfamoyl, and N,N-diethylsulfamoyl; sulfonyl having preferably 1 to 50 carbon atoms, for example, methanesulfonyl, octanesulfonyl, benzenesulfonyl, and toluenesulfonyl; alkoxycarbonyl having preferably 2 to 50 carbon atoms, for example, methoxycarbonyl, butyloxycarbonyl, dodecyloxycarbonyl, and octadecyloxycarbonyl; heterocyclyloxy having preferably 1 to 50 carbon atoms, for example, 1-phenyltetrazole-5-oxy, and 2-tetrahydropyranyloxy; azo having preferably 6 to 50 carbon atoms, for example, phenylazo, 4-methoxyphenylazo, 4-pivaloylaminophenylazo, and 2-hydroxy-4-propanoylphenylazo; acyloxy having preferably 2 to 50 carbon atoms, for example, acetoxy; carbamoyloxy having preferably 2 to 50 carbon atoms, for example, N-methylcarbamoyloxy and N-phenylacarbamoyloxy; silyloxy having preferably 3 to 50 carbon atoms, for example, trimethysilyloxy and dibutylmethylsilyloxy; aryloxycarbonylamino having preferably 7 to 50 carbon atoms, for example, phenoxycarbonylamino; imido having preferably 1 to 40 carbon atoms, for example, N-succinimido, N-phthalimido, and 3-octadecenylsuccinimido; heterocyclylthio having preferably 1 to 50 carbon atoms, for example, 2-benzothiazolythio, 2,4-diphenoxy-1,3,5-triazole-6-thio, and 2-pyridylthio; sulfinyl having preferably 1 to 50 carbon atoms, for example, dodecanesulfinyl, 3-pentadecylphenylsulfinyl, and 3-phenoxypropylsulfinyl; phosphonyl having preferably 1 to 50 carbon atoms for example, phenoxyphosphonyl, octyloxyphosphonyl, and phenylphosphonyl; arloxycarbonyl having preferably 7 to 50 carbon atoms, for example, phenoxycarbonyl; acyl having preferably 2 to 50 carbon atoms, for example, acetyl, 3-phenylpropanoyl, benzoyl, and 4-dodecyloxybenzoyl; and azolyl having preferably 1 to 50 carbon atoms, for example, imidazolyl, pyrazolyl, 3-chloro-pyrazole-1-yl, and triazolyl.

When $R^1$ is a ballast group it is a group of such size and configuration that, in combination with the remainder of the molecule, it provides the coupler with sufficient bulk that the coupler is substantially non-diffusible from the layer in which it is coated in the photographic element. Representative ballast groups include substituted or unsubstituted alkyl or aryl groups containing 8 to 32 carbon atoms. Other ballast groups include substituted or non-substituted alkoxy, aryloxy, arylthio, alkylthio, alkoxycarbonyl, aryloxycarbonyl, carboxy, acyl, acyloxy, carbonamido, carbamoyl, alkylcarbonyl, arylcarbonyl, alkysulfonyl, arylsulfonyl, sulfamoyl, sulfenamoyl, alkylsulfinyl, arylsulfinyl, alkylphosphonyl, arylphosphonyl, alkoxyphosphonyl, and arylphosphonyl. Ballast groups including silicon substituted groups can be employed. Other ballast groups known in the photographic art can be employed.

Specific couplers within the scope of the present invention have structures as follows:

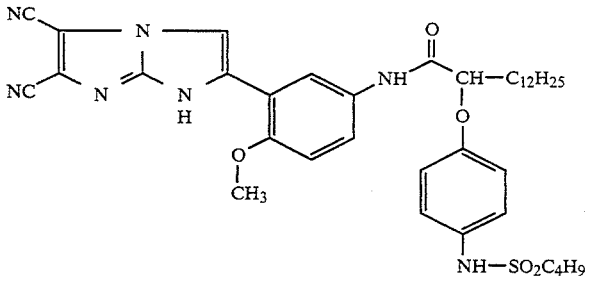

C-1

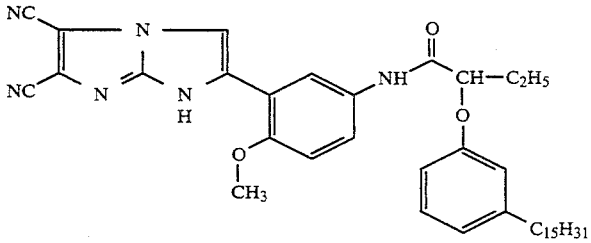

C-2

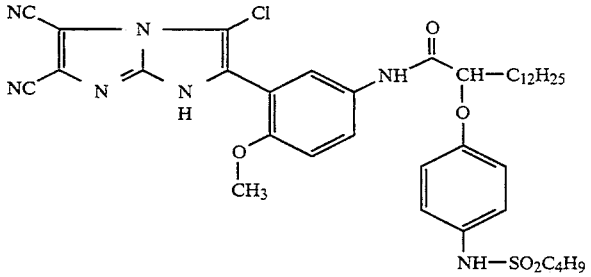

C-3

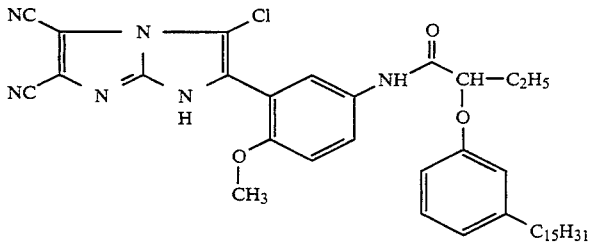

C-4

-continued
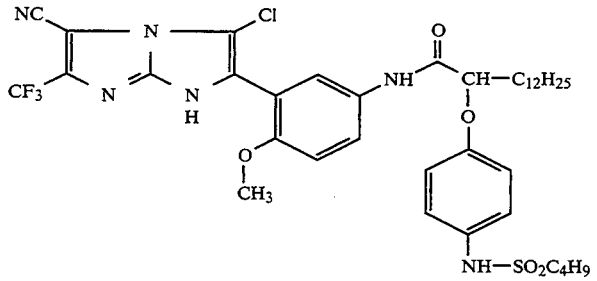
C-5
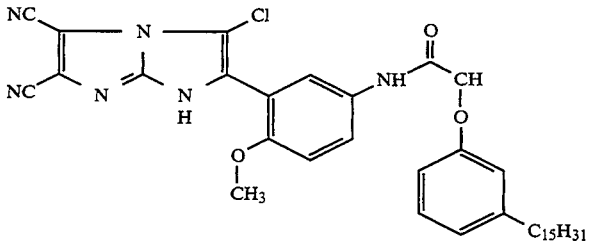
C-6
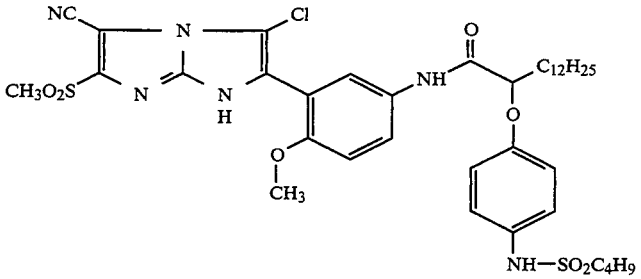
C-7
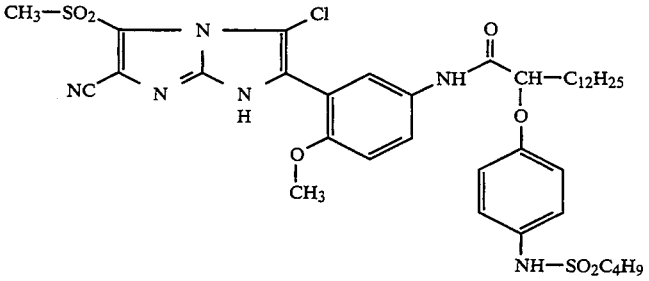
C-8
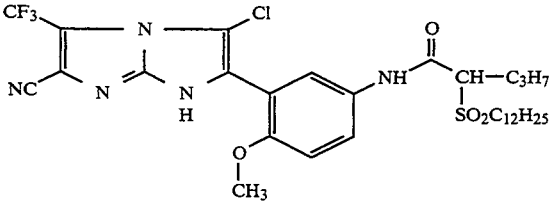
C-9
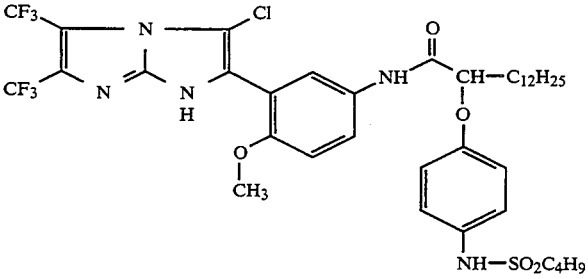
C-10

-continued
C-11
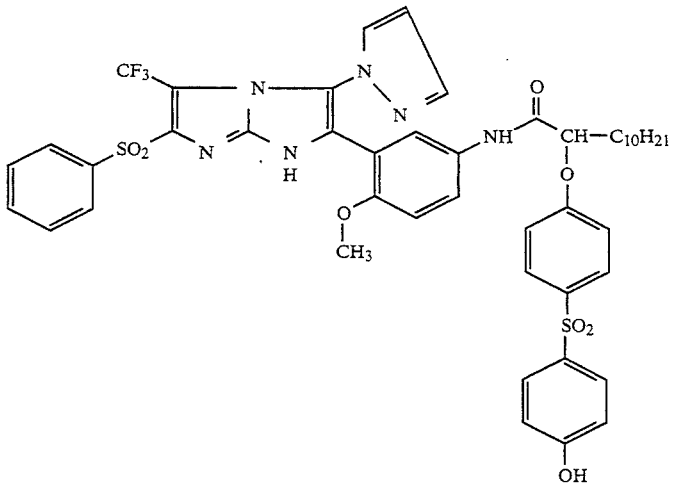
C-12
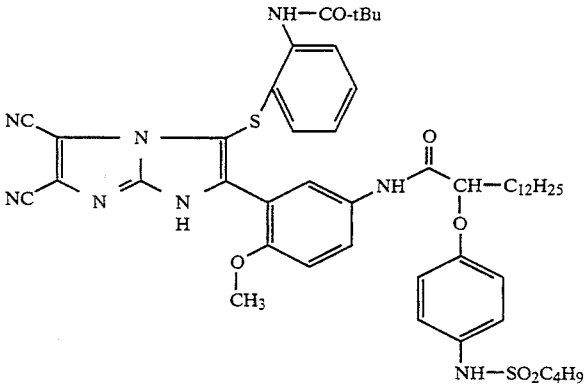
C-13
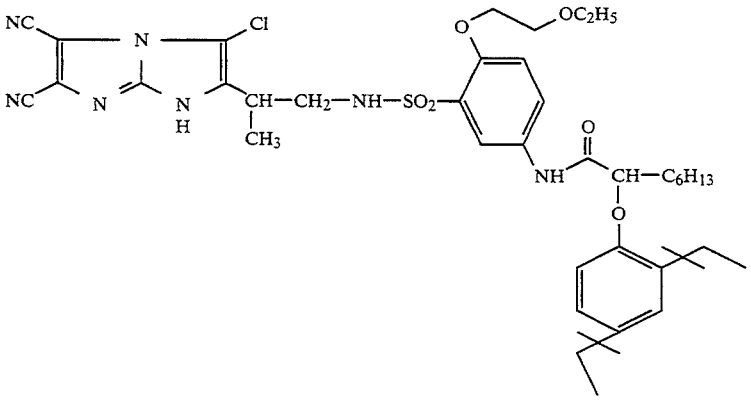

-continued

C-14

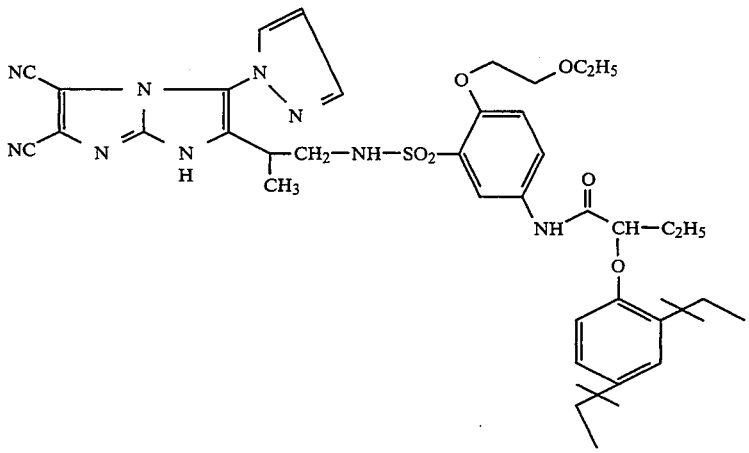

C-15

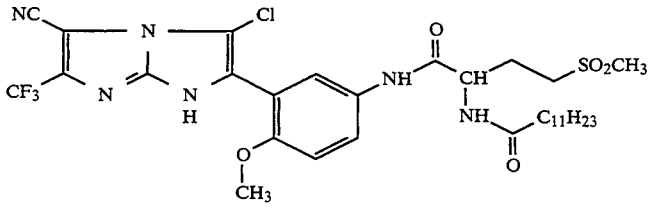

C-16

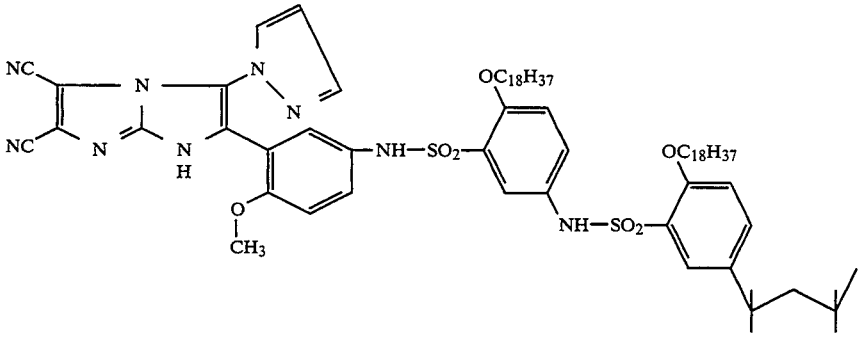

The photographic elements of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the cyan couplers described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (See Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section IX), plasticizers and lubricants (See Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

The coupler compounds can be used and incorporated in photographic elements in the way that such compounds have been used in the past. Incorporation by use of a coupler solvent, as shown in the working examples, is a preferred technique.

The photographic elements of this invention can be exposed to actinic radiation, typically in the visible region of the spectrum, to form a latent image, as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Or, a direct positive emulsion can be employed to obtain a positive image.

Development is followed by the conventional steps of bleaching, fixing, or bleach-fixing, to remove silver and silver halide, washing and drying.

Couplers of the invention can be prepared by reactions and methods known in the organic synthesis art. A typical synthesis is illustrated by the following example.

EXAMPLES

Synthesis of Coupler (C-1)

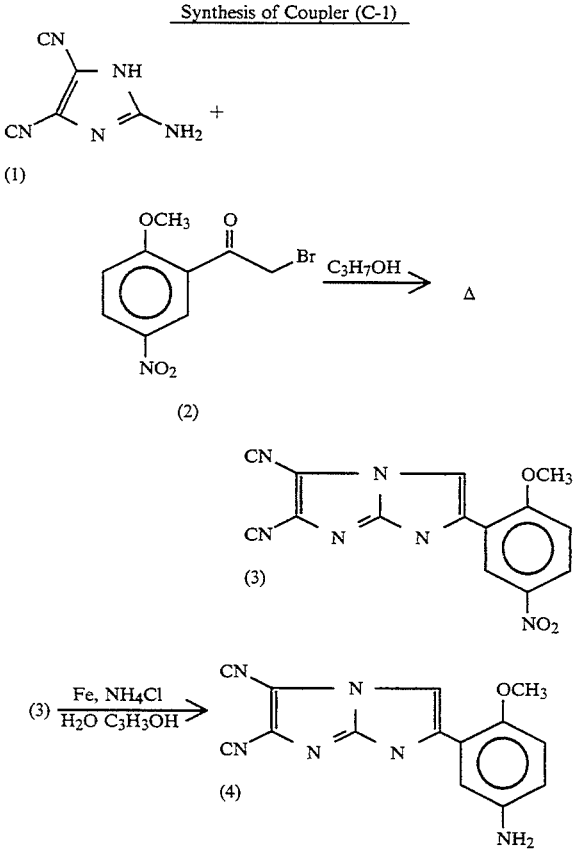

-continued

Synthesis of Coupler (C-1)

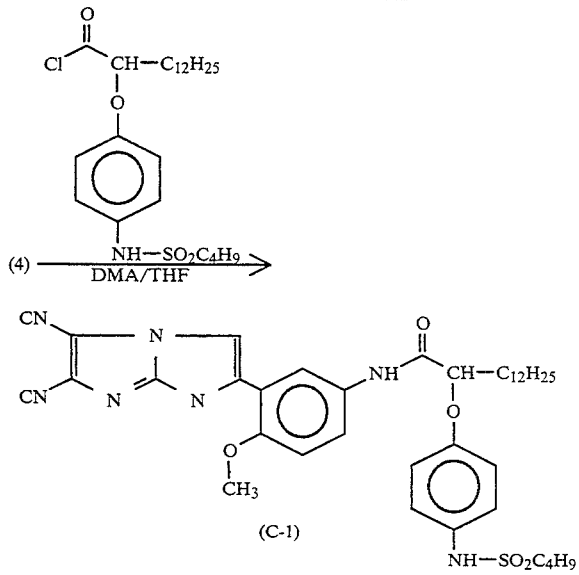

A mixture of 19.97g (0.15 mol) of 2-amino-4,5-imidazoledicarbonitrile and 42.76g (0.156 mol) of 2-bromo-2'-methoxyl-5'-nitroacetophenone in 200 mL of n-propanol was heated at reflux for 4 h. The reaction was completed, as confirmed by the thin layer chromatography (TLC) (elution EEOAc/$CH_2Cl_2$: $\frac{1}{4}$). The resulting solid was collected by filtrating the hot reaction mixture, washed with ligroin and dried in vacuo to yield 18.83 g (40.72%) of the desired product as an off-white solid: mp 295° C. Analytical data confirmed the assigned structure (3).

A mixture of 3.35 g (0.06 tool) of iron powder, 0.27 g (0.005 tool) of ammonium chloride, 0.28 mL (0.005 mol) of acetic acid, 4 mL (0.223 mol) of water and 21 mL of isopropanol was heated at reflux. 3.08 g (0.01 mol) of the imidazo[3,2-a]imidazole coupler nitro compound (3) was added and the reaction mixture was heated at reflux for 2 h. The reaction was completed, as confirmed by TLC analysis (elution: $CH_3COOC_2H_5/CH_2Cl_2$: $\frac{1}{4}$). 200 mL of tetrahydrofurans (THF) was added and the mixture was heated at reflux for 1 h. followed by the hot filtration of the reaction mixture. The fill rate was concentrated in vacuo to yield 2.67 g (96%) of the corresponding amine.

A mixture of the coupler amine (4), 1.28 mL (0.0101 mol) of N,N-dimethylaniline in 120 mL of dried THF was cooled to 5° C., followed by the dropwise addition of 4.79 g (0.0101 mol) of 2-(4-((butylsulfonyl)amino)-phenoxy)tetradecanoyl chloride in 10 mL of THF. After the addition had been completed, the reaction mixture was stirred 3 h. at room temperature. The reaction was completed as confirmed by TLC analysis. The reaction mixture was concentrated in vacuo to about 10 mL and poured into a mixture of ice and water containing 0.58 mL of concentrated HCl. The resulting solid was collected by filtration and dried in vacuo to yield 6.71 g (98%) of the desired coupler as an off-white solid. The solid was purified by column chromotography (silica gel, eluant:Ether/$CH_2Cl_2$:1/5) to afford 2.74 g of coupler (C-1) (40%): mp 110° C. Analytical data confirmed the assigned structure.

The following example illustrates the practice of the present invention and the advantage in coupling characteristics that couplers of this invention have when compared with a coupler of the type generally described in Bailey et al. U.S. Pat. No. 4,728,598.

Preparation and Evaluation of Photographic Elements

Dispersions of the couplers shown in Table I were prepared in the following manner. In one vessel, the coupler (Cl, 0.928 g), di-n-butyl phthalate (0.464 g), and ethyl acetate (2.78 g) were combined and warmed to dissolve. In a second vessel, gelatin (2.15 g), a surfactant, Alkanol XC TM (0.21 g) (E. I. dupont Co.) and water (28.67 g) were combined and passed three times through a colloid mill. The ethyl acetate was removed by evaporation and water was added to restore the original weight after milling.

The photographic elements were prepared by coating the following layers in the order listed on a resin-coated paper support:

| | |
|---|---|
| 1st layer | |
| Gelatin | 3.23 g/m$^2$ |
| 2nd layer | |
| Gelatin | 1.61 g/m$^2$ |
| Coupler (see Table 1) | 0.00086 mol/m$^2$ |
| Coupler Solvent | 0.5 weight of coupler |
| Red sensitized AgCl emulsion | 0.387 g/m$^2$ |
| 3rd layer | |
| Gelatin | 1.22 g/m$^2$ |
| 2-(2H-benzotriazol-2-yl)-4,6-bis-(1,1-dimethylpropyl)phenol | 0.731 g/m$^2$ |
| Tinuvin 326 TM (Ciba-Geigy) | 0.129 g/m$^2$ |
| 4th layer | |
| Gelatin | 1.40 g/m$^2$ |
| Bis(vinylsulfonylmethyl) ether | 0.135 g/m$^2$ |

The photographic elements were given a stepwise exposure to green light and processed as follows at 35° C.:

| | |
|---|---|
| Developer | 45 seconds |
| Bleach-Fix | 45 seconds |
| Wash (running water) | 1 minute, 30 seconds |

The developer and bleach-fix were of the following compositions:

| | |
|---|---|
| Developer | |
| Water | 700.00 mL |
| Triethanolamine | 12.41 g |
| Blankophor REU TM (Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| N-{2-[(4-amino-3-methylphenyl) ethylamino]ethyl}methanesulfonamide sesquisulfate | 5.00 g |
| 1-Hydroxyethyl-1,1-diphosphonic acid (60%) | 0.81 g |
| Potassium carbonate, anhydrous | 21.16 g |
| Potassium chloride | 1.60 g |
| Potassium bromide | 7.00 mg |
| Water to make | 1.00 L |
| Ph @ 26.7 C. adjusted to 10.04 ± 0.05 | |
| Bleach-Fix | |
| Water | 700.00 mL |
| Solution of ammonium thiosulfate (54.4%) + ammonium sulfite (4%) | 127.40 g |
| Sodium metabisulfite | 10.00 g |
| Acetic acid (glacial) | 10.20 g |
| Solution of ammonium ferric ethylenediaminetetraacetate (44%) + | 110.40 g |

-continued

| | |
|---|---|
| ethylenediaminetetraacetic acid (3.5%) | |
| Water to make | 1.00 L |
| pH @ 26.7° C. adjusted to 5.5 | |

From the processed film strips there was measured Contrast, Dmin and Dmax. The results are reported in Table 1, below:

TABLE 1

| Coupler | Contrast | Dmin | Dmax |
|---|---|---|---|
| C-1 (Invention) | 2.05 | 0.037 | 2.05 |
| C-2 (Invention) | 2.33 | 0.045 | 2.03 |
| CC-1 (Comparison) | 1.75 | 0.100 | 1.83 |
| CC-2 (Comparison) | 0.63 | 0.118 | 1.19 |

CC-1

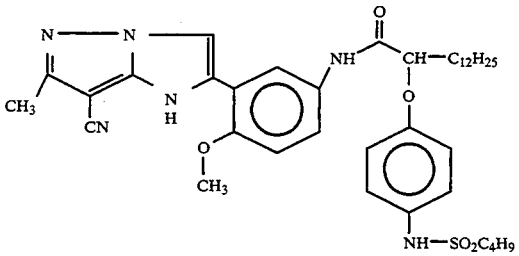

CC-2

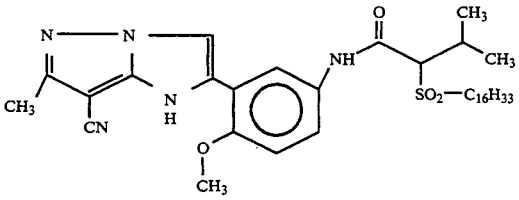

The data in Table 1 indicate that the couplers according to the present invention offer improved coupling efficiency and Dmin compared with the couplers from the prior art.

This invention has been described in detail with particular reference to preferred embodiments thereof. It will be understood that variations and modifications can be made within the spirit and scope of the invention.

What is claimed is:

1. A light-sensitive photographic element comprising a support bearing a silver halide emulsion associated with a imidazo[3,2-a]imidazole cyan dye-forming coupler having the structure:

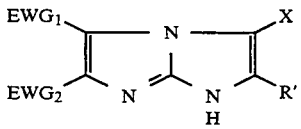

wherein:

$EWG_1$ and $EWG_2$ each independently represent an electron withdrawing group;

X is hydrogen or a coupling-off group; and $R^1$ is hydrogen or a substituent group; and the dye formed on coupling with an N-{2-[(4-amino-3-methylphenyl)ethylamino]ethyl}methanesulfonamide sesquisulfate developing agent has a spectral absorption peak in the region of the spectrum from 650 to 710 nm with a half band width of less than 195 nm.

2. A photographic element of claim 1, wherein the coupler provides a dye that has a half band width of less than 100 nm.

3. A photographic element of claim 1, wherein the electron withdrawing groups have Hammett sigma p values of between 0.2 and 1.0.

4. A photographic element of claim 3, wherein the electron withdrawing groups are selected from alkoxycarbonyl, nitro, cyano, arylsulfonyl, carbamoyl, halogenated alkyl and aryloxycarbonyl.

5. A photographic element of claim 4 wherein the electron withdrawing groups are each cyano.

6. A photographic element of claim 1, wherein the coupler is represented by one of the following formulae:

C-1

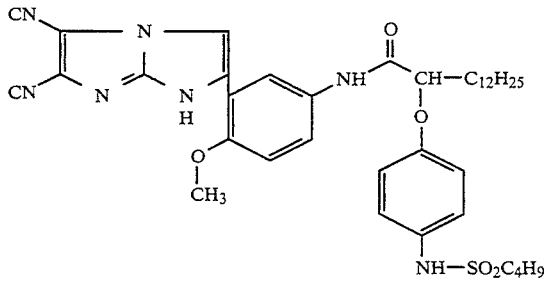

C-2

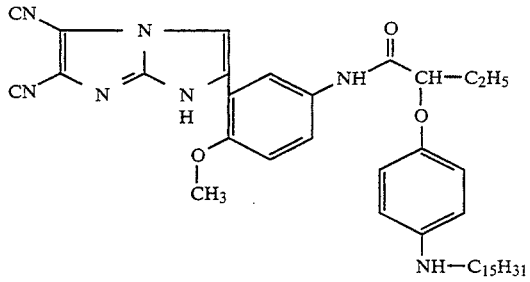

C-3

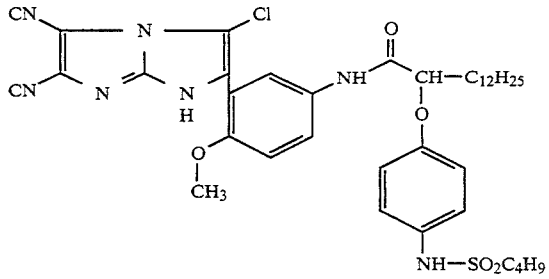

C-4

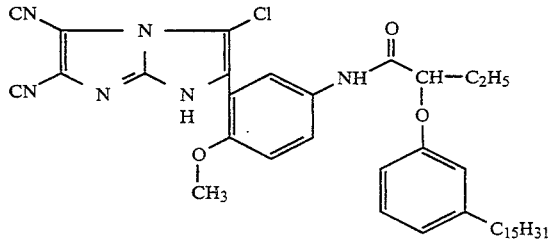

7. A photographic element of claim 1, wherein the silver halide emulsion comprises silver chlorobromide containing greater than 90 mole percent chloride.

8. A photographic element of claim 1, wherein the silver halide emulsion comprises silver chloride.

9. A photographic element of claim 7, wherein the element comprises a reflective support.

* * * * *

UNITED STATES PATENT AND TRADEMARK OFFICE

CERTIFICATE OF CORRECTION

PATENT NO. : 5,441,863

DATED : August 15, 1995

INVENTOR(S) : Tang et al.

It is certified that error appears in the above-indentified patent and that said Letters Patent is hereby corrected as shown below:

Columns 17 and 18, delete the structures in claim 6 and insert the following structures:

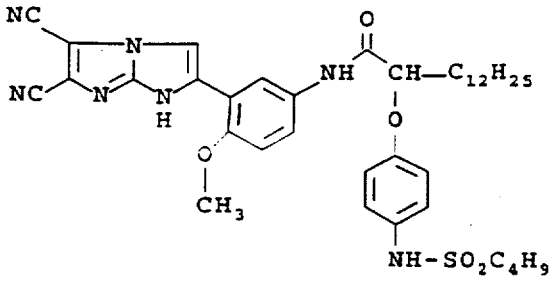

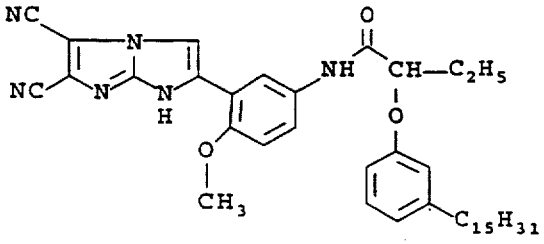

UNITED STATES PATENT AND TRADEMARK OFFICE

CERTIFICATE OF CORRECTION

PATENT NO. : 5,441,863

DATED : August 15, 1995

INVENTOR(S) : Tang et al.

It is certified that error appears in the above-indentified patent and that said Letters Patent is hereby corrected as shown below:

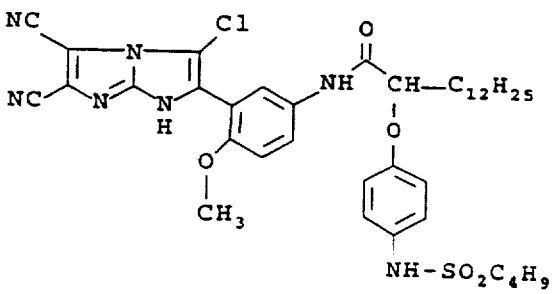

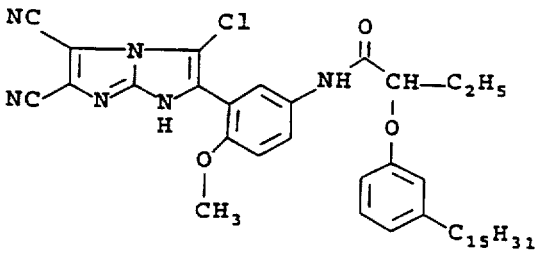

Signed and Sealed this

Twenty-eighth Day of November 1995

*Attest:*

BRUCE LEHMAN

*Attesting Officer*

*Commissioner of Patents and Trademarks*